United States Patent [19]

Harris

[11] 4,026,537

[45] May 31, 1977

[54] METHOD OF AND MACHINERY FOR PRODUCING BOOKBLOCKS

[75] Inventor: John William Harris, Kettering, England

[73] Assignee: Timsons Limited, Kettering, England

[22] Filed: May 13, 1975

[21] Appl. No.: 577,040

[30] Foreign Application Priority Data

May 14, 1974 United Kingdom ..... 21205/74

[52] U.S. Cl. ..... 270/14; 270/60

[51] Int. Cl.[2] ..... B41F 13/64

[58] Field of Search ..... 270/1–22, 270/37–38, 42–44, 54–58, 45, 47, 48, 51, 52

[56] References Cited

UNITED STATES PATENTS

| | | | |
|---|---|---|---|
| 2,019,658 | 11/1935 | Crafts | 270/6 |
| 2,631,845 | 3/1953 | Zuckerman | 270/5 |
| 3,525,516 | 8/1970 | Bushnell | 270/54 |
| 3,977,665 | 8/1976 | Bowman | 270/4 |

*Primary Examiner*—Edgar S. Burr
*Assistant Examiner*—A. Heinz
*Attorney, Agent, or Firm*—Hibben, Noyes & Bicknell, Ltd.

[57] ABSTRACT

A method and apparatus for assembling a block for a book or book section in a 2-up coming and going method of bookmaking by providing a stream of groups of book elements, each group containing all the primary pages of the book or book section. The groups of the stream are divided into first and second series and the groups of the first series are conveyed to a combining station around a turn-over member rotating about a horizontal axis so that each group of the first series is turned through 180°. The groups of the second series are separately conveyed to the combining station and each group is arranged to be in half-block form before it reaches the combining station. At the combining station, the half-blocks of the series and the half-blocks of the second series are brought together in pairs by bringing each half-block of one series under a half-block of the other series to form blocks each comprising a half-block of the first series and a half-block of the second series. The passage around the rotary member causes each half-block of the first series to arrive at the combining station in an orientation in which it has been turned through 180° about an axis parallel to the junction between the two pages of each leaf of the half-block relative to the orientation of each half-block of the second series arriving at the combining station.

1 Claim, 3 Drawing Figures

METHOD OF AND MACHINERY FOR PRODUCING BOOKBLOCKS

BACKGROUND OF THE INVENTION

Field of the Invention

This invention relates to 2-up coming and going methods of bookmaking. The term "book" is used herein in a broad sense to mean any assembly of pages arranged in a required order and includes not only printed books in the normal sense but, for example, diaries and any collection of printed sheets arranged in a required order.

Bookmaking using the 2-up coming and going method involves making two books or book sections at once from a paper web which has been printed so that each successive length of the web shows a number of pages each of which appears only once, the pages being printed in such positions that after slitting, cutting, if necessary folding, and collating a half block is formed which has two side-by-side sequences of pages. This half-block contains all the pages, hereinafter referred to as the primary pages, of the book or book section which have been printed on the web. Each side of each leaf of the half-block shows two pages arranged head-to-head or tail-to-tail, one page being from one sequence and the other page being from the other sequence. Each sequence contains half the primary pages of the book or section, one sequence containing the primary pages of the first half of the book or section in proper order and the other sequence containing the primary pages of the second half of the book or section in proper order. If one considers the order of the primary pages in each sequence with respect to one face of the half-block then the primary pages in one sequence "go" from that face while the primary pages in the other sequence "come" to that face.

In addition to the primary pages the half-block may also include secondary or inserted pages such as drawings, photographs or title pages which are not printed in the same operation as the printing of the web referred to above. These inserted pages may, for example, be fed into the half-block during collating. Alternatively, the inserted pages may be grouped together in a separately printed insert section which may be fed between two half-blocks when the half-blocks are combined to form a block as described below, may be added to one of the half-blocks before the half-blocks are combined, or may be fed onto the top or bottom of the block after the half-blocks have been combined.

A book consisting of, for example, 192 primary pages, may be made by arranging one face of each half-block to show pages 1 and 192 while the leaf at the opposite face of each half- block will show pages 96 and 97. Pages 1 to 96 will in each half- block go from the one face to the other and pages 97 to 192 of that half-block will come to that face from the other face.

A block is then made by the imposition of one half-block on another identical half-block which is reversed in position relative to the one half-block so that the block thus formed can be separated into two books each of which will have all the required primary pages.

Thus in the example given above, the faces of the two half-blocks which show pages 96 and 97 would be juxtaposed with page 96 of each half-block opposite page 97 of the other half- block.

As previously indicated, two book sections can also be made at once using the 2-up coming and going method described above. In this instance a block will be formed which is a double book section and which can be separated into two book sections each of which will have all the required pages.

The above double book section can be combined, prior to separation, with other sections of the book printed using the 2-up coming and going method to produce a larger block which can be separated into two complete books.

The half-blocks referred to above will be made up from sheets or signatures, hereinafter referred to as "book elements".

Summary of the Invention

The invention is concerned with a continuous method of, and apparatus for, assembling in the correct relative position two halves of a block for a double book or double book section in the 2-up coming and going method of bookmaking.

According to one aspect of the invention we provide a method of assembling a block for a double book or double book section in a 2-up coming and going method of bookmaking in which successive lengths of a paper web have each been identically printed so that each length shows in total a number of primary book pages each of which appears once only, the method of assembling comprising providing a stream of identical groups of book elements, each group consisting of leaves formed by at least cutting and slitting one of said lengths and containing all of said primary pages arranged in pairs on the leaves head to head or tail to tail with each pair of pages meeting in a junction; separately conveying the groups of said first and second series to a combining station; collating the elements of each group into a half-block; at said combining station bringing together in pairs the half-blocks of said first series and the half blocks of said second series by bringing each half-block of one of said first and second series under a half-block of the other of said first and second series thus to form blockseach comprising a half-block of said first series and a half-block of said second series; and turning each group of elements constituting a half-block of said first series through 180° about a horizontal axis during its conveyance to the combining station so that each half-block of the first series arrives at said combining station in an orientation in which it has been turned through 180° about an axis parallel to said junction between said two pages printed on the leaves of the half-block of the first series relative to the orientation of each half-block of said second series arriving at said combining station.

According to another aspect of the invention we provide apparatus for assembling a block for a double book or a double book section in a 2-up coming and going method of bookmaking in which successive lengths of a paper web have each been identically printed so that each length shows in total a number of primary book pages each of which appears once only, the apparatus comprising supply means arranged to supply groups of book elements, each group consisting of leaves formed by at least cutting and slitting one of said lengths and containing all of said primary pages arranged in pairs on the leaves head to head or tail to tail with each pair of pages meeting in a junction; means for dividing said groups into first and second series; a rotary member rotatable about a horizontal axis and arranged to turn over a succession of said groups; a combining station; first conveying means to convey the groups of said first series around said rotary member by which each group is turned through 180° about an axis parallel to said junction between said two pages printed on the leaves of the group; second conveying means for conveying groups of said second series from dividing means to said combining station; means for collating the elements of each group into a half-block; and means for bringing together in pairs, to form blocks, the half-blocks of said first series and the half-blocks of said second series by bringing successive half-blocks of one of said first and second series under successive half-blocks of the other of said first and second series whereby each block comprises one half-block of said first series and one half-block of said second series; the first and second conveying means and collating means being arranged so that the passage around said rotary member causes each half-block of said first series to arrive at said combining station in an orientation in which it has been turned through 180° about an axis parallel to said junction between said two pages printed on the leaves of the half-block of the first series relative to the orientation of each half-block of said section series arriving at said combining station The supply means may supply a stream of book elements which are fed downwardly, groups of the stream being collated into said first series of half-blocks and fed around said rotary member and other groups of the stream being separately collated into said second series of half-blocks, the half-blocks being brought together in pairs by feeding successive half-blocks of the one of series under successive half-blocks of the other of the series.

In this arrangement the groups forming said other series are preferably collated at a location nearer to said combining station that the location at which the groups of said one series are collated. Preferably the groups of said other series are collated immediately adjacent to said combining station.

The collation of the groups of at least one series may be effected by feeding the book elements into upwardly open pockets of rotatable delivery members or grippers. A number of successive groups of said stream may be collated into the half-blocks of said first series and the next number of successive groups of said stream may be collated in the half-blocks of said series and so on.

Preferably the groups of said first series are collated before passing around the rotary member and the groups of said second series are collated adjacent to said combining station. The one collating means for collating the groups of said first series may comprise a rotary delivery bucket with a plain peripheral portion and may be located adjacent to the path of said stream so that the groups forming said one series are received in the pockets of the delivery bucket and then the plain portion of the delivery bucket is presented to the path to allow the groups of said other series to pass downwardly to the second collating means for collation into half-blocks.

Preferably, the stream of groups of book elements is fed directly from folding and/or cutting means. Thus the apparatus embodying the invention may be placed directly at the end of a printing line where a web is printed appropriately for the 2-up coming and going method of bookmaking, the web is then slit, folded and cut to form a stream of signatures, or merely slit and cut to form a stream of sheets and these are either fed directly and collated in the apparatus or may first be collated into half-blocks and then fed into the apparatus. If inserted pages are to be included in the half-blocks these may be fed in during collating. Alternatively inserted pages may be grouped in a separately printed insert section as described above.

If desired, the apparatus may be fed with uncollated signatures or sheets or with half-blocks which have not come direct from a printing line but are supplied from a store by a continuous delivery system or, in the case of half-blocks, a separate collator.

It will therefore be seen that the invention provides an apparatus for continuously producing a series of blocks for a double book or double book section using the 2-up coming and going method of bookmaking.

Brief Description of the Drawings

The invention will now be described in detail by way of example with reference to the accompanying drawings in which.

Description of a Preferred Embodiment

The principles of 2-up coming and going bookmaking will first be explained briefly with reference to FIGS. 1 and 2 and with reference to the manufacture of a book consisting of 192 primary pages.

Figure 1:
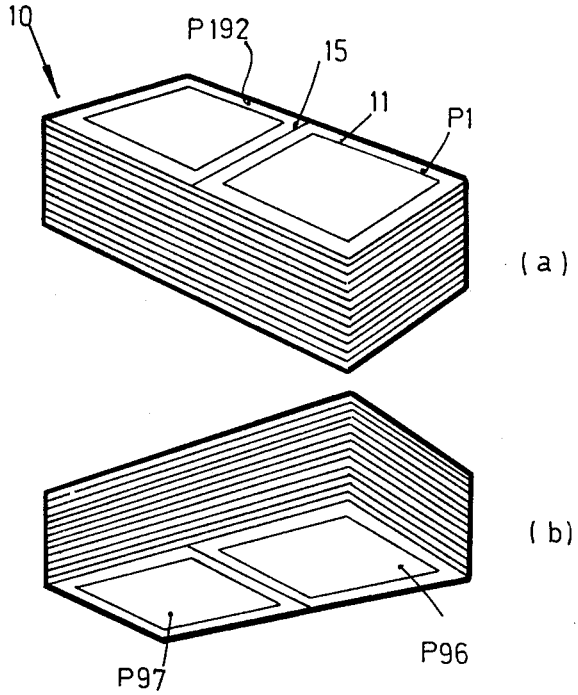
FIGS. 1(*a*) and 1(*b*) shown a block for a double book and shows the upper and lower faces thereof respectively.

Referring first to FIG. 1, this shows a half-block for a double book indicated generally at 10 used in the manufacture of two 192 page books. Each leaf of the half-block shows, on each side, two pages which are arranged either head-to-head or tail-to-tail. The upper leaf 11 of the half-block shown in FIG. 1(*a*) shows pages 1 and 192. The leaf at the lower face of the half-block shown in FIG. 1(*b*) shows pages 96 and 97. There are two page sequences through the half-bookblock, thus there is the right- hand page sequence which goes from page 1 to page 96 and there is the left-hand sequence of pages which comes from pages 97 to 192. The "going" and "coming" is with reference to the face of the half-block at which the leaf 11 is situated. It will be appreciated that each leaf is printed on each side thereof.

Figure 2:
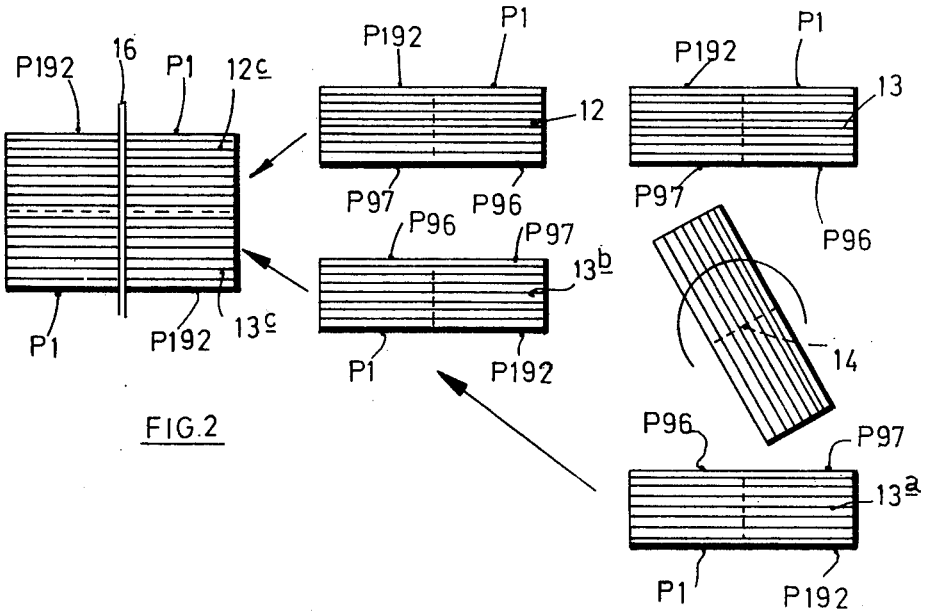
FIG. 2 is a diagram illustrating how two identical half blocks can be placed together to for a block from which two books can be made.

FIG. 2 shows two half-blocks identical to that shown in FIG. 1, the half-blocks being indicated at 12 and 13 and the numbers of the pages shown at opposite faces of the half-block being indicated. The two-half-blocks are shown side by side at the top of the figure in the same orientation. The half-block 13 is not turned through 180° about an axis 14 which is parallel to he junction 15, shown in FIG. 1, between the two pages shown on each leaf of the half-block. The half-block 13 is shown after having completed its turn at 13*a*. It will be seen that pages 96 and 97 are now shown at the upper face of the half-block and are reversed left to right, with respect to their positions with the half-block in the position 13. Thus at 13*a* page 96 is to the left and page 97 is to the right wheras when the half-block is in the position shown at 13, page 97 is to the left and page 96 to the right. The half-block 13 can now be moved to a position such as shown at 13*b* in which it lies under the half-block 12 and it will be seen that the page 96 of the half-block 13 lies under page 97 of the half-block 12 while page 97 of the half-block 13 lies under page 96 of the half-block 12. Thus when the two half-blocks are placed together as shown at 12*c* and 13*c* one has a block for a double book. On the right hand side the pages go downwardly from 1 to 192 while on the left hand side the pages come upwardly from page 1 to page 192. The block can now be cut as indicated at 16 to form two books. Normally the block for a double book will be bound before being cut into the separate books.

It will be seen from the foregoing diagrammatic explanation that it is necessary to turn one of the half-blocks forming the block for a double book through 180° with respect to the other half bookblock and then to superimpose the two half-blocks so as to get the whole series of pages coming at one side of the block and going at the other. The invention is concerned with a method of an apparatus for turning and putting together the half-blocks from which double books or double book sections are formed.

Figure 3:
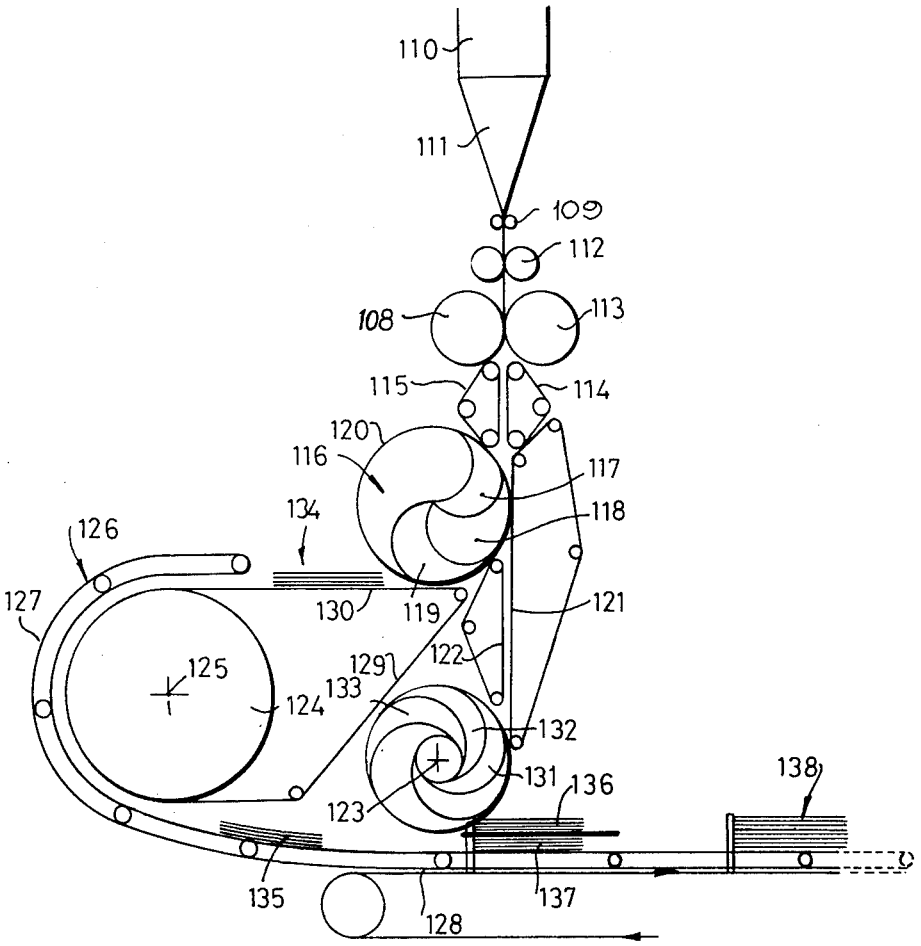
FIG. 3 is a diagram of apparatus embodying the invention.

Referring now to FIG. 3 this shows one form of apparatus for assembling such blocks. There is supplied to the apparatus a number of slit ribbons 110. These ribbons will have been slit from a web which has been printed on both sides in the manner appropriate for 2-up coming and going bookmaking. The ribbons are folded in a folding device III so that when they have been cut, as will be described below, the ribbons will provide 24 page signatures. The invention will be described in relation to a book having 192 pages. Thus each half-block will have 96 pages and will consist of four signatures. The folded ribbons will pass through two sets of rolls 109 and 112, the rolls 112 acting as draw rolls and the folded ribbons will then be cut into signatures between a cutting roll 113 and a resist roll 108. There will thus be provided, issuing from between the rolls 113 and 108, a stream of signatures, each signature comprising 24 pages. The stream will consist of repeating groups of signatures which will, for the purpose of description, be referred to as signatures 1, 2, 3 and 4. Thus each half-block will consist of a stack of signatures 1, 2, 3 and 4 and the complete block will consist of two half-blocks and therefore two of each of the signatures.

The group of signatures are fed from the rolls 113 and 108 by a first set of delivery tapes 114, 115. A first collating means is provided in the form of a delivery bucket cylinder 116, this being rotatable about a horizontal axis. The cylinder 116 has three pockets 117, 118 and 119 whose mouths occupy half the periphery of the cylinder whereas the remaining half of the periphery of the cylinder which is indicated at 120 is plain.

There is a second pair of delivery tapes 121 and 122 and these lead to a second collating means in the form of a second delivery bucket cylinder 123. This collater 123 has its periphery formed entirely of the mouths of a number of pockets.

A turn-over drum is indicated at 124 and is rotatable about a horizontal axis 125. Associated with the turn-over drum is a tape system 126 which has an arcuate portion 127 embracing the drum and a horizontal portion 128. There is also a further tape system 129 which is in contact with the drum and which has a horizontal run 130.

With the parts in the positions shown in FIG. 3, a group of four signatures will be delivered one at a time into the pocket 117. The signature 1 will be at the bottom and the signature 4 will be at the top. The cylinder 116 will be rotating and by the time the four signatures have been received in the pocket 117 the plain portion 120 of the periphery will be presented to the tape system 121 so that the next group of signatures pass down between the surface 120 and the tape system 121 so as to be delivered to the collater 123 between the tape system 121 and 122. In fact, three groups of signatures will be delivered to the collater 123 and delivered into the pockets 131, 132 and 133 respectively. The collater 123 is rotating in a clockwise direction. The groups of signatures delivered into the pockets of the cylinder 116 will constitute a first series of signatures and the groups of signatures delivered into the pockets of the cylinder 123 will constitute a second series of signatures.

Returning to the collater 116, the pockets 118 and 119 will previously have each been provided with a group of four signatures and when the pocket 119 comes over the horizontal run 130, it will deliver the group of signatures, which constitute a half-block, onto the run at the position indicated at 134. The half-block will then pass around the turn-over drum 125 between the tape systems 126 and 129 and in being turned about the drum will be turned through 180° about a horizontal axis which will be parallel to the junction between the two pages printed on each lead of the half-block. The half-block will emerge from the turn-over drum 125 at the position indicated at 135 with signature 1 uppermost whereas at the position 134 signature 4 is uppermost. The half-block at 135 will then be moved to the right on the horizontal run 128 of the tape system 126 and will have delivered onto the top thereof a half-block from one of the pockets of the collater 123, such a half-block being indicated at 136 and being delivered onto a half-block 137. The half-block 136 will have signature 4 uppermost so that the half- blocks will be reversed relative one another as is required. The resulting complete block is then moved to the right on the horizontal run 128 and such a bookblock is indicated at 138 and may be delivered along the horizontal run 128 to the binder where the block will be bound and then cut into two separate books.

It will be seen, therefore, that the apparatus may be inserted between the output from the printing, folding, slitting and cutting machine and the binder and thus can continuously deliver to the binder complete blocks for double books for binding and cutting into separate books. Instead of collating the groups of signatures in the pockets of the delivery buckets 116 and 123 the apparatus can be modified to receive an input of collated half-bookblocks. When modified in this manner the tapes 114 and 115 will deliver a collated half-block to each of the pockets of the delivery buckets and these half-blocks will then proceed through the apparatus in the same manner as the half-blocks 134, 135, 136 and 137 referred to above.

The arrangement shown in FIG. 3 may also be modified by replacing each of the delivery bucket cylinders 116 and 123 with three grippers each of which corresponds to one of the pockets of the cylinders. The three grippers replacing the bucket cylinder 116 will be rotatable about a common horizontal axis in the same manner as the cylinder 116 and will be arranged to deliver three consecutive half-blocks onto the horizontal run 130 while the three gripers replacing the bucket cylinder 123 will be arranged to deliver the next three consecutive half- blocks onto three consecutive half-blocks on the horizontal run 128.

In the arrangement shown in FIG. 2, the apparatus has been set up to produce blocks which include only primary pages. The apparatus may, however, be modified to feed inserted pages into the half-blocks during collating or to add a separately printed insert section as discussed above.

Also, each of the foregoing examples, the stream has consisted of groups of signatures. However it would be within the invention to provide groups of single sheets in place of signatures.

It will be seen that the invention provides a comparatively simple and effective means for assembling block for double books and, as previously indicated, can also be employed to produce blocks for double-book sections.

I claim:

1. Apparatus for assembling a block for a double book or a double book section in a 2-up coming and going method of bookmaking in which successive lengths of a paper web have each been indentically printed so that each length shows in total a number of primary book pages each of which appears once only, the apparatus comprising supply means arranged to supply groups of book elements, each group containing all of said primary pages and consisting of leaves formed by cutting and slitting one of said lengths, said primary pages being arranged in pairs on the leaves in a head-to-head or tail-to-tail configuration with each pair of pages meeting in a junction; means for dividing said groups into first and second series, said dividing means comprising a first delivery bucket cylinder rotatable about a horizontal axis, the cylinder having a series of arcuately disposed pockets for receiving and conveying said first series of groups and a plain peripherial portion which directs said second series of groups to a second delivery bucket cylinder, the first cylinder during rotation receiving in said pockets from the supply means groups destined to be the first series of groups and presenting said plain portion of said periphery to groups destined to form the second series of groups; a rotary member rotatable about a horizontal axis and arranged to turn over a succession of said first series of groups; a combining staton; first conveying means to receive the groups of said first series from said pockets and to convey them around the rotary member by which each group is turned through 180° about an axis parallel to said junction between the two pages printed on the leaves of the group; said second delivery bucket cylinder having pockets therein, and located adjacent the combining station the pockets having mouths at the periphey of the cylinder; second conveying means for conveying groups of said second series past the plain portion of the periphery of the said first delivery bucket cylinder to said second delivery bucket cylinder to be received in the pockets thereof; third conveying means for conveying the groups of said first series from said rotary member to the combining station; the second delivery bucket cylinder and the third conveying means bringing together in pairs, to form blocks, groups of said first series and groups of the second series by bringing successive groups of the first series under successive groups of the second series whereby each block comprises one group of the first series and one group of the second series; the first and thrid conveying means and said rotary member being arranged so that passage around the latter causes each group of the first series to arrive at the combining station in an orientation in which it has been turned through 180° about an axis parallel to said junction between said two pages printed on the leaves of the group of the first series relative to the orientation of each group of the second series being delivered from the second delivery bucket cylinder at the combining station.

* * * * *